US005746073A

United States Patent [19]

Wise et al.

[11] Patent Number: 5,746,073

[45] Date of Patent: *May 5, 1998

[54] DYE TUBE SPACER FOR PACKAGE DYEING

[75] Inventors: Gordon A. Wise, Statesville; Roger N. Saunders, Yadkinville; Matthew M. Thomas, Reidsville; Raymond W. Maynard, Advance; Ronald W. Mangrum, Greensboro, all of N.C.

[73] Assignee: Unifi, Inc., Reidsville, N.C.

[ * ] Notice: The term of this patent shall not extend beyond the expiration date of Pat. No. 5,490,401.

[21] Appl. No.: 746,300

[22] Filed: Nov. 8, 1996

Related U.S. Application Data

[63] Continuation of Ser. No. 600,032, Feb. 12, 1996, Pat. No. 5,617,748, which is a continuation of Ser. No. 284,305, Aug. 2, 1994, Pat. No. 5,490,401.

[51] Int. Cl.[6] ..... D06B 23/04

[52] U.S. Cl. ..... 68/198

[58] Field of Search ..... 68/198, 189; 242/118.1, 242/118.11, 118.2, 118.41, 530.1; 285/13, 14

[56] References Cited

U.S. PATENT DOCUMENTS

| | | | |
|---|---|---|---|
| 1,928,251 | 9/1933 | Gollong | 68/198 |
| 1,928,252 | 9/1933 | Gollong | 68/198 |
| 2,007,914 | 7/1935 | Elling | 68/198 |
| 2,065,526 | 12/1936 | Huttinger | 68/198 |
| 2,216,034 | 9/1940 | Jaeger et al. | 68/198 |
| 2,226,394 | 12/1940 | Stienen | 68/198 |
| 4,665,722 | 5/1987 | Ashley et al. | 68/198 |
| 5,490,401 | 2/1996 | Wise et al. | 68/198 |

FOREIGN PATENT DOCUMENTS 0 233 365 B1 12/1986 European Pat. Off. .

OTHER PUBLICATIONS

Two drawing pages of German Patent No. 932 548.
Copy of Tigges Catalog; Undated.
Correspondence dated Jul. 30, 1993.

*Primary Examiner*—Philip R. Coe
*Attorney, Agent, or Firm*—Rhodes Coats & Bennett, L.L.P.

[57] ABSTRACT

A dye tube spacer for package dyeing. The spacer prevents distortion of the ends of the yarn package when the package is compressed prior to dyeing. The spacer includes a continuous vertical inner wall having an upper edge and a lower edge, the inner diameter of the wall being substantially equal to the outer diameter of the tube. A vertical outer wall is spaced from the inner wall and has an upper edge and a lower edge. A top annular wall is inclined upwardly from the upper edge of the inner to the upper edge of the outer wall, the wall having a diameter substantially equal to the diameter of the end of the yarn winding. A bottom annular wall extends from the lower edge of the inner wall to the lower edge of the outer wall. A support shelf extends inwardly from the inner wall and is positioned to engage the end of the tube. The inclined top and bottom annular walls contact the ends of the yarn packages and prevent undesirable distortion of the yarn during compression prior to dyeing.

8 Claims, 2 Drawing Sheets

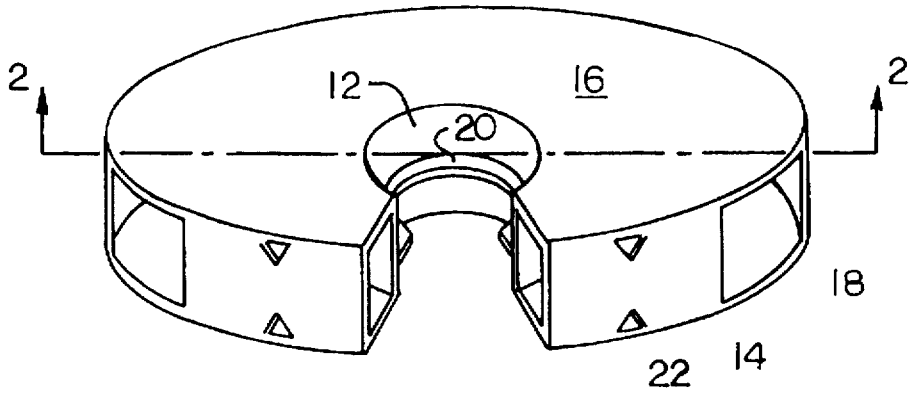
FIG. 1
FIG. 2
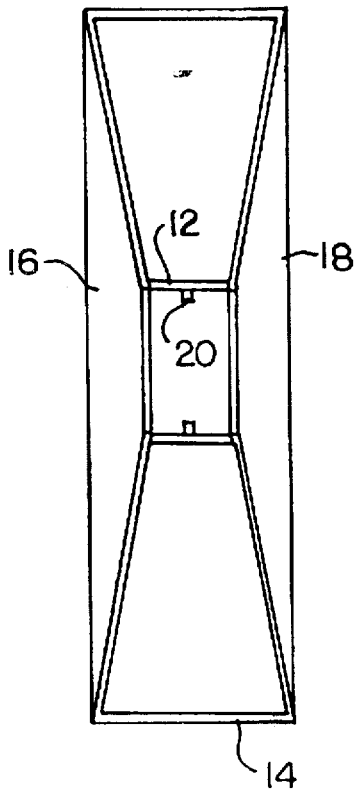
FIG. 3
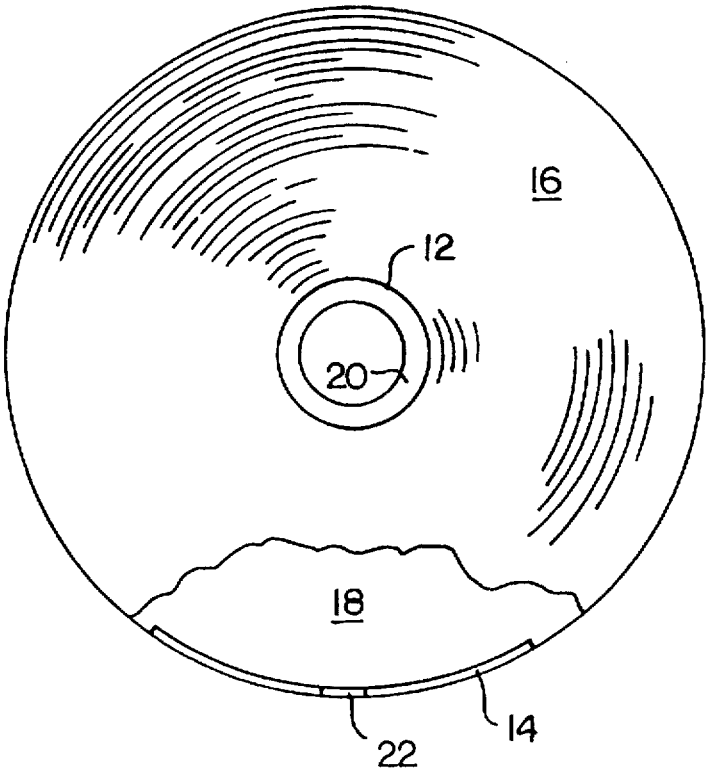

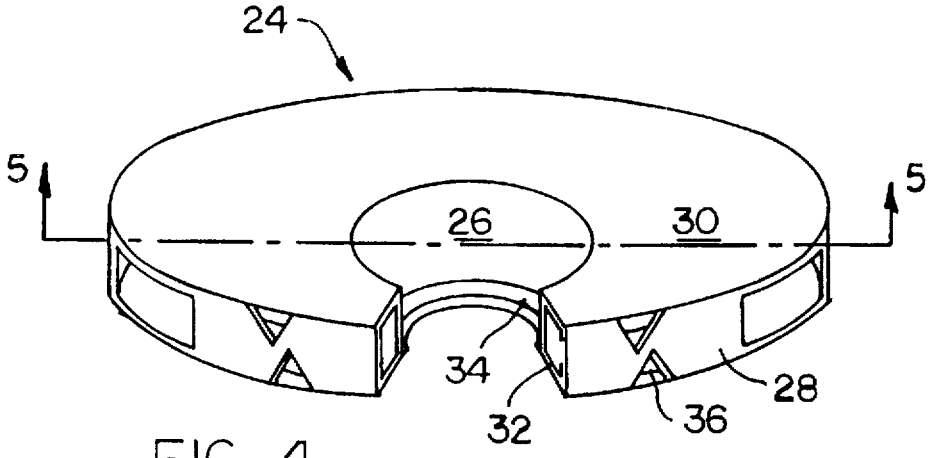
FIG. 4
FIG. 5
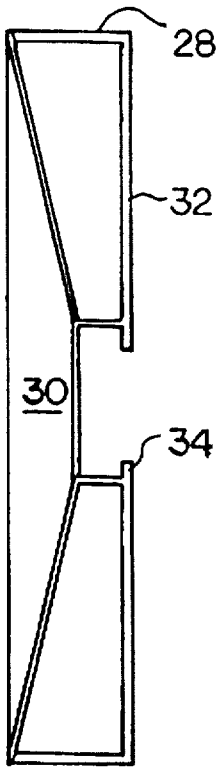
FIG. 6
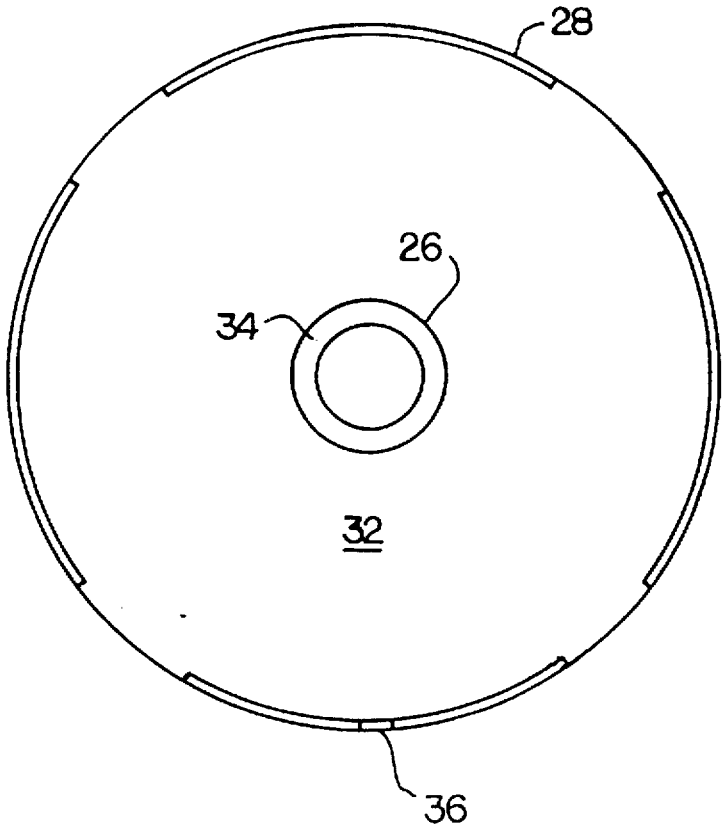

DYE TUBE SPACER FOR PACKAGE DYEING

This application is a continuation of application No. 08/600.032, filed Feb. 12, 1996, and now U.S. Pat. No. 5,617,748, in turn a continuation of application Ser. No. 08/284.305, filed Aug. 2, 1994 and now U.S. Pat. No. 5,490.401.

BACKGROUND OF THE INVENTION (1) Field of the Invention

The present invention relatess generally to package dyeing systems and, more particularly, to a dye tube spacer for preventing undesirable distortion of a compressed yarn package during dyeing.

(2) Description of the Prior Art

In conventional package dyeing, a plurality of yarn packages, each including a yarn winding around a tube, are placed on a spindle having a diameter substantially equal to the inner diameter of the tube. The yarn packages are then compressed by exerting pressure on the ends of the spindles. The yarn packages are compressed to compensate for variations in package density and to allow more packages to be loaded into the dyeing vessel. However, because the ends of adjacent packages engage one another, the ends of the yarn packages can be distorted. This problem is usually correctable during backwinding when the yarn is inspected, lubricated and rewound on new tubes prior to shipment to the end use customer.

However, recently there has been research directed at producing a dyed yarn package which can be directly shipped to the customer without inspecting, lubricating and rewinding. Numerous technical obstacles must be overcome before such a dyed yarn package becomes practical. These problems include better dyeing control, combined dyeing and lubricating in a single operation and high speed compressible dye tubes. In addition, it would no longer be possible to correct the distortion of the ends of the yarn packages during backwinding when the yarn is inspected, lubricated and rewound on new tubes prior to shipment to the end use customer since this step would be eliminated.

Thus, there remains a need for a new and improved dye tube spacer which allows the yarn packages to be compressed prior to dyeing while, at the same time, prevents distortion of the ends of the yarn packages during compression thereby allowing the package to be shipped directly to the end user without rewinding.

SUMMARY OF THE INVENTION

The present invention is directed to a dye tube spacer for package dyeing which prevents distortion of the ends of the yarn package when the package is compressed prior to dyeing. The spacer includes a continuous vertical inner wall having an upper edge and a lower edge, the inner diameter of the wall being substantially equal to the outer diameter of the tube. A vertical outer wall is spaced from the inner wall and has an upper edge and a lower edge. A top annular wall is inclined upwardly from the upper edge of the inner to the upper edge of the outer wall, the wall having a diameter substantially equal to the diameter of the end of the yarn winding. A bottom annular wall extends from the lower edge of the inner wall to the lower edge of the outer wall. A support shelf extends inwardly from the inner wall and is positioned to engage the end of the tube. The inclined top and bottom annular walls contact the ends of the yarn packages and prevent undesirable distortion of the yarn during compression prior to dyeing.

Accordingly, one aspect of the present invention is to provide a dye tube spacer. The spacer includes: (a) a cylindrical inner wall having an upper edge and a lower edge; (b) an outer wall spaced from the inner wall and having an upper edge and a lower edge; (c) an top annular wall is inclined upwardly from the upper edge of the inner to the upper edge of the outer wall and (d) a bottom annular wall extending from the lower edge of the inner wall to the lower edge of the outer wall.

Another aspect of the present invention is to provide a dye tube spacer. The spacer includes: (a) a continuous vertical inner wall having an upper edge and a lower edge; (b) a vertical outer wall spaced from the inner wall and having an upper edge and a lower edge; (c) a top annular wall inclined upwardly from the upper edge of the inner to the upper edge of the outer wall; (d) a lower annular wall inclined downwardly from the lower edge of the inner wall to the lower edge of the outer wall; and (e) a horizontal, annular support shelf extending inwardly from the inner wall.

Still another aspect of the present invention is to provide a spacer for supporting a yarn package formed of a tube with upper and lower ends and a winding of yarn with inwardly inclined ends thereon. The spacer includes: (a) a continuous vertical inner wall having an upper edge and a lower edge, the inner diameter of the wall being substantially equal to the outer diameter of the tube; (b) a vertical outer wall spaced from the inner wall and having an upper edge and a lower edge; (c) a top annular wall inclined upwardly from the upper edge of the inner to the upper edge of the outer wall, the wall having a diameter substantially equal to the diameter of the end of the yarn winding; (d) a bottom annular wall extending from the lower edge of the inner wall to the lower edge of the outer wall; and (e) a support shelf extending inwardly from the inner wall and positioned to engage the end of the yarn tube.

These and other aspects of the present invention will become apparent to those skilled in the art after a reading of the following description of the preferred embodiment when considered with the drawings.

BRIEF DESCRIPTION OF THE DRAWINGS

FIG. 1 is a cutaway perspective view of an intermediate dye tube spacer constructed according to the present invention;

FIG. 2 is a cross-sectional end view of the intermediate dye tube spacer of FIG. 1, taken along line 2—2;

FIG. 3 is a cutaway top view of the intermediate dye tube spacer;

FIG. 4 is a perspective view of an end dye tube spacer constructed according to the present invention;

FIG. 5 is a cross-sectional end view of the end dye tube spacer of FIG. 1, taken along line 5—5; and FIG. 6 is a cross-sectional top view of the end dye tube spacer;

DESCRIPTION OF THE PREFERRED EMBODIMENTS

In the following description, like reference characters designate like or corresponding parts throughout the several views. Also in the following description, it is to be understood that such terms as "forward", "rearward", "left", "right", "upwardly", "downwardly" and the like are words of convenience and are not to be construed as limiting terms.

Referring now to the drawings in general and FIG. 1 in particular, it will be understood that the illustrations are for the purpose of describing a preferred embodiment of the invention and are not intended to limit the invention thereto. As best seen in FIG. 1, a dye tube spacer, generally 10, includes a continuous, circular, vertical inner wall 12 or open-ended cylinder, a circular vertical outer wall or open-ended cylinder 14. Vertical walls 12 and 14 are joined at their upper edges by a top wall 16 and at their lower edges by a bottom wall 18. A ledge 20 extends inwardly from wall 12, equidistant its upper and lower edges. Walls 12 and 14 are axially aligned around the vertical axis of spacer 10.

The height of inner wall 12 is preferably equal to approximately twice the length of the dye tube extending beyond the yarn packages to be dyed, plus the width of ledge 20 when the yarn packages are in a compressed state. Normally, the height will be from about 35 to about 50 mm. The internal diameter of inner wall 12 is substantially equal, or slightly less than the outer diameter of the dye tubes, or normally from about 75 to about 80 mm. Thus, the dye tube ends slip into the inner opening of the spacer with the ends against the sides of ledge 20 when the packages are compressed.

Annular outer wall 14 is concentric with inner wall 12 and spaced therefrom to form an annular space between walls 12 and 14. Outer wall 14 is formed of identical arcuate segments which are equally spaced from each other. Wall segment includes triangular shaped drainage openings 22 which have their bases adjacent walls 16 and 18, respectively. Since the purpose of openings 22, as well as the spaces between the arcuate sections, are for drainage and weight savings, other outer wall configurations to address these considerations will be obvious to the skilled artisan. For example, the outer wall may be continuous with equally spaced circular or rectangular openings or other support structure spaced from the inner wall to provide drainage and weight savings while supporting the top and bottom walls.

The central cross-section of outer wall 14 lies in a horizontal plane with the central cross-section of wall 12. Thus, walls 12 and 14 each having equal segments above and below this horizontal plane. The length of wall 14 is greater than the length of wall 12, however, so that the segments of wall 14 project further above or below the horizontal plane than the corresponding segments of wall 12. The diameter of wall 14, and its length, will be determined by the diameter of the yarn package and the angle of the yarn winding at the end of the package. The horizontal plane is perpendicular to the vertical axis of spacer 10.

Annular top wall 16 extends from an inner edge integral and coextensive with the upper edge of inner wall 12 to an outer edge integral and coextensive with the upper edge of inner wall 14. Since outer wall 14 projects further above the horizontal plane of the spacer than inner wall 12, top wall 16 is inclined upwardly and away from the horizontal plane in the direction of outer wall 14. This angle should be equal to the corresponding angle of the end of the yarn package, which will normally be from about 5° to about 25°, preferably about 10°, from the horizontal plane. Since the horizontal plane is perpendicular to the vertical axis of the dye tube spacer, this angle corresponds to an angle of from about 65° to about 85°, preferably about 80°, from the vertical axis of the dye tube spacer.

Similarly, annular bottom wall 18 extends from an inner edge integral and coextensive with the lower edge of inner wall 12 to an outer edge integral and coextensive with the lower edge of inner wall 14. Since outer wall 14 also projects further below the horizontal plane of the spacer than inner wall 12, bottom wall 16 is inclined downwardly and away from the central plane in the direction of outer wall 14. This angle will be equal to the corresponding angle of top wall 16, i.e.,from about 5° to about 25°, preferably about 10°, from the central plane, or from about 65° to about 85°, preferably about 80°, from the vertical axis of the dye tube spacer.

Horizontal, annular ledge 20 projects inwardly from inner wall 12 and is positioned equidistant between the upper and lower edges of wall 12 along the horizontal plane. The width of ledge 20 preferably approximates the thickness of the dye, providing maximum support, without unduly projecting into the center of inner wall 12, and thus interfering with insertion of the spindle. Thus the width of ledge 20 will normally be from about 8 to about 10 mm.

From the foregoing description, and the illustration of the intermediate dye tube spacer, it will be apparent that the upper half of the intermediate spacer is a mirror image of the bottom half of the intermediate spacer. Therefore, the spacer can be used with either wall 14 or wall 16 as the top wall.

The dye spacer used at the ends of the group of yarn packages is only about one-half the width of the intermediate dye tube spacer, and has the configuration of one-half of the intermediate spacer, with a planer wall covering the opposite side. As best seen in the Figures, the end dye tube spacer, or cap, generally 24, includes a continuous, circular, vertical inner wall 26 or open-ended cylinder, and a circular vertical outer wall, generally 28. Vertical walls 26 and 28 are joined at their upper edges by a top wall 30 and at their lower edges by a bottom wall 32. A ledge 34 extends inwardly from wall 26, adjacent wall 32. Vertical walls 26 and 28 are axially aligned around the central vertical axis of spacer 24.

The height of inner wall 26 is preferably equal to approximately one-half the length of wall 12, or a length equal to the length of one dye tube extending beyond a yarn package to be dyed when the yarn passages are in a compressed state, plus the thickness of ledge 34, which is approximately the thickness of ledge 20. Normally, the height of inner wall 26 will be from about 17 to about 25 mm. The internal diameter of inner wall 26 is substantially equal to the inner diameter of wall 12.

Annular outer wall 28 is concentric with inner wall 26 and spaced therefrom to form an annular space between walls 26 and 28. Outer wall 28 is formed of identical arcuate segments which are equally spaced from each other. Each wall segment includes triangular-shaped drainage openings 36. As in intermediate dye tube spacer 10, the purpose of openings 36, as well as the spaces between the arcuate sections, is for drainage and weight savings, and other outer wall configurations may be used to address these considerations.

The bottom ends or openings of inner walls 26 and 28 lie within a horizontal plane which is perpendicular to the vertical axis of spacer 24. Wall 28 is of a greater length than wall 26, however, so that the upper end of wall 28 is higher than the upper end of wall 26. The inner and outer diameters of wall 26, will be the same at the inner and outer diameters of wall 14.

Annular top wall 30 extends from an inner edge which is integral and coextensive with the upper edge of inner wall 26 to an outer edge which is integral and coextensive with the upper edge of outer wall 28. Since outer wall 28 projects further above the central plane of the spacer than inner wall 26, top wall 30 is inclined upwardly and away from the central plane in the direction of outer wall 28. This angle will be equal to the angle of top wall 14, or from about 5° to about 25°, preferably about 10°, from the central plane, or from about 65° to about 85°, preferably about 80°, from the vertical axis of spacer 24.

Unlike bottom wall 18 of intermediate dye tube spacer 10, annular bottom wall 32 of spacer or cap 24 is planer and lies in the horizontal plane with the lower ends of walls 26 and 28, and extends from an inner edge integral and coextensive with the lower edge of inner wall 26 to an outer edge integral and coextensive with the lower edge of outer wall 28.

Horizontal, annular ledge 34 is only required to abut the end on one yarn tube, i.e., the outer end of the last yarn tube on the spindle on the end when spacer 24 is inserted over the spindle. Therefore, ledge 34 projects inwardly from inner wall 26 in the same way that inner wall 12 projects inwardly from ledge 20, but is positioned in the horizontal plane with bottom wall 32. The width of ledge 34 preferably approximates the thickness of ledge 20.

In operation, a plurality of yarn packages, each including a yarn winding around a tube, are placed on a spindle having a diameter substantially equal to the inner diameter of inner walls 12 and 26, with adjacent packages separated by intermediate dye tube spacers 10. End spacers 24 are inserted over the spindle at each end, with the top spacer being inverted from the aspect illustrated herein, so that top wall 30 faces downward to engage the side of the yarn winding on the top yarn package. The yarn packages are then compressed by exerting pressure on the end spacers. This pressure may be exerted before or after the yarn packages are inserted onto a dyeing rack or into a dyeing kettle. As a result of the present invention, there is no significant distortion of the yarn packages from this pressure. Therefore, the packages can be used in subsequent operations without the need for rewinding.

Certain modifications and improvements will occur to those skilled in the art upon a reading of the foregoing description. By way of example, two ledges can be used instead of one ledge in the intermediate dye tube spacer. Also, the top and bottom wall can extend beyond the outer wall. In addition, while the spacer is preferrably formed from hollow walled stainless steel, other non-corrossive materials could be substituted. It should be understood that all such modifications and improvements have been deleted herein for the sake of conciseness and readability but are properly within the scope of the following claims.

We claim:

1. A rigid dye tube spacer for separating adjacent ends of a plurality of yarn packages, each having a yarn winding around a tube, said yarn packages placed on a spindle in a package dyeing vessel and compressed prior to dyeing to compensate for variations in package density and to allow more packages to be loaded in said package dyeing vessel, said spacer comprising:

(a) a cylindrical inner wall having an upper edge and a lower edge;

(b) a top annular wall inclined upwardly from the upper edge of said inner wall;

(c) a bottom annular wall extending from the lower edge of said inner wall, wherein said top and said bottom annular walls extend substantially the entire width of and conform substantially to the share of the end of said yarn package to prevent undesirable distortion of the yarn package during the compression operation; and (d) an open support structure spaced from said inner wall and hating an upper end attached to said top annular wall and a lower end attached to said bottom annular wall to maintain the position of said top annular wall and said bottom annular wall during compression.

2. The dye tube spacer of claim 1, wherein said bottom wall is inclined downwardly from the lower edge of said inner wall.

3. The dye tube spacer of claim 1, further including a tube support shelf extending inwardly from said inner wall.

4. The dye tube spacer of claim 3, wherein said shelf is positioned equidistant between the upper and lower edges of said inner wall.

5. A rigid dye tube spacer for separating adjacent ends of a plurality of yarn packages, each having a yarn winding around a tube, said yarn packages placed on a spindle in a package dyeing vessel and compressed prior to dyeing to compensate for variations in package density and to allow more packages to be loaded in said package dyeing vessel, said spacer comprising:

(a) a cylindrical inner wall having an upper edge and a lower edge;

(b) a top annular wall inclined upwardly from the upper edge of said inner wall at an angle of between about 5° to 25° from the horizontal plane;

(c) a bottom annular wall extending from the lower edge of said inner wall, wherein said top and said bottom annular walls extend substantially the entire width of and conform substantially to the shape of the end of said yarn package to prevent undesirable distortion of the yarn package during the compression operation; and (d) an open support structure spaced from said inner wall and having an upper end attached to said top annular wall and a lower end attached to said bottom annular wall to maintain the position of said top annular wall and said bottom annular wall during compression.

6. The dye tube spacer of claim 5, wherein said bottom wall is inclined downwardly from the lower edge of said inner wall at an angle of between about 5° to 25° from the horizontal plane.

7. The dye tube spacer of claim 5, further including a tube support shelf extending inwardly from said inner wall.

8. The dye tube spacer of claim 5, wherein said shelf is positioned equidistant between the upper and lower edges of said inner wall.

* * * * *

UNITED STATES PATENT AND TRADEMARK OFFICE

CERTIFICATE OF CORRECTION

PATENT NO. : 5,746,073

DATED : May 5, 1998

INVENTOR(S) : Gordon A. Wise et al.

It is certified that error appears in the above—identified patent and that said Letters Patent is hereby corrected as shown below:

Column 6:

In Claim 1 (c), Line 4, "share" should be --shape--.

Signed and Sealed this

Fourteenth Day of July, 1998

Bruce Lehman

*Attest:*

BRUCE LEHMAN

*Attesting Officer*

*Commissioner of Patents and Trademarks*